US006697581B2

(12) United States Patent
Ohtani et al.

(10) Patent No.: US 6,697,581 B2
(45) Date of Patent: Feb. 24, 2004

(54) IMAGE FORMING APPARATUS

(75) Inventors: Hideyuki Ohtani, Iwatsuki (JP); Toshihiro Suganuma, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/369,587

(22) Filed: Feb. 21, 2003

(65) Prior Publication Data

US 2003/0228165 A1 Dec. 11, 2003

(30) Foreign Application Priority Data

Jun. 10, 2002 (JP) ..... 2002-169264

(51) Int. Cl.[7] ..... G03G 15/00; G03G 15/16

(52) U.S. Cl. ..... 399/38; 399/71; 399/101; 399/3.2

(58) Field of Search ..... 399/38, 66, 71, 399/98, 101, 297, 302, 308, 349, 353, 354, 357

(56) References Cited

U.S. PATENT DOCUMENTS 6,405,002 B2 * 6/2002 Ogiyama et al. ..... 399/101

6,615,015 B2 * 9/2003 Nakazawa et al. ..... 399/302

FOREIGN PATENT DOCUMENTS

JP A 2001-075448 3/2001

* cited by examiner

*Primary Examiner*—Hoang Ngo
(74) *Attorney, Agent, or Firm*—Oliff & Berridge, PLC

(57) ABSTRACT

Disclosed is an image forming apparatus which is compact and inexpensive, and which allows cleaning of a final transfer member. The image forming apparatus includes: an image bearing member; an image forming unit that forms a toner image on the surface of the image bearing member; an intermediate transfer device formed by at least one intermediate transfer member, and which is in contact with the image bearing member; a final transfer member which is in contact with the intermediate transfer member; a cleaning member which is in contact with the intermediate transfer member; and a control unit that controls the potential gradient between the image bearing member, the intermediate transfer member, the final transfer member, and the cleaning member, in which the control unit forms in an image formation mode a potential gradient for image formation which causes reverse-polarity toner on the final transfer member to adhere to the cleaning member by way of the intermediate transfer member.

27 Claims, 9 Drawing Sheets

IMAGE FORMING APPARATUS

FIELD OF THE INVENTION AND RELATED ART STATEMENT

The present invention relates to an electrophotographic image forming apparatus, such as a copying machine, a printer, a facsimile, or a multifunction apparatus formed by combining them, and in particular, to an improvement in a cleaning technique for an image forming apparatus.

Up to now, image forming apparatuses utilizing the electrophotographic system (the electrostatic transfer system), such as copying machines and printers, are widely known. In such image forming apparatuses, a toner image is transferred to a recording sheet by a final transfer member, and then the toner image is fixed to thereby obtain a toner image as a permanent image on the recording sheet. Here, it is necessary to remove the toner which has not been transferred to the recording sheet by means of a cleaning device in the image forming apparatus. Apart from this ordinary image formation, a so-called process control is also performed, in which reference marks are formed on the image bearing member, the intermediate transfer member, and the final transfer member, and in which registration control and toner image density control are effected on the basis of the positions, density, etc. of the reference marks (patches). Here, in the process control, the reference marks (patches) are not usually transferred to the recording sheet, so that the marks have to be removed by the cleaning device in the image forming apparatus.

Regarding the cleaning inside the image forming apparatus, the following techniques have been proposed. JP 2001-75448 A discloses a technique in which the residual toner on the intermediate transfer member and the final transfer member is collected on the final transfer member, and collectively removed by a cleaning device which is in contact with the final transfer member. Further, there might be a technique according to which the final transfer member is spaced apart from the intermediate transfer member during the process control so that the reference marks may not adhere to the final transfer member.

However, in many cases, the final transfer member is arranged at an end portion inside the image forming apparatus, and the construction in which there is further provided a cleaning device, which is in contact with the final transfer member, is likely to lead to an increase in the size of the image forming apparatus. Further, when the final transfer member is constructed so as to allow contact and separation to and from the intermediate transfer member, the apparatus is rather complicated, resulting in an increase in cost.

OBJECT AND SUMMARY OF THE INVENTION

The present invention has been made in view of the above-mentioned technical problem, and provides an image forming apparatus which is compact and inexpensive, and which allows cleaning of the final transfer member.

Thus, according to an aspect of the present invention, an image forming apparatus includes: an image bearing member; an image forming unit that forms a toner image on the surface of the image bearing member; an intermediate transfer device which is formed by at least one intermediate transfer member, and which is in contact with the image bearing member; a final transfer member which is in contact with the intermediate transfer member; a cleaning member which is in contact with the intermediate transfer member;

and a control unit that controls the potential gradient between the image bearing member, the intermediate transfer member, the final transfer member, and the cleaning member, in which the control unit forms in an image formation mode a potential gradient for image formation which causes reverse-polarity toner on the final transfer member to adhere to the cleaning member by way of the intermediate transfer member.

Here, the image forming units include a charging unit that uniformly charges the surface of the image bearing member, a latent image forming unit (exposure unit) that forms an electrostatic latent image corresponding to the output image on the surface of the image bearing member, and a developing unit that selectively imparts toner to the electrostatic latent image formed on the surface of the image bearing member. A variation of the charging unit is a contact type charging unit which is in contact with the image bearing member and is adapted to uniformly charge the surface thereof. In this case, the control unit is capable of controlling the potential gradient not only between the image bearing member, the intermediate transfer member, the final transfer member, and the cleaning member, but also between them and the contact type charging unit.

By thus constructing the image forming apparatus, the reverse-polarity toner on the final transfer member adheres to the cleaning member by way of the intermediate transfer member in the image formation mode, so that, firstly, there is no need to provide the final transfer member with a cleaning device. That is, it is possible to construct the image forming apparatus such that the cleaning member does not come into contact with (or is held in a non-contact state with respect to) the final transfer member. Secondly, there is no need to frequently perform the cleaning mode operation. The image forming potential gradient is a potential gradient which allows the toner image as the output image on the image bearing member to be transferred to the recording sheet transported between the intermediate transfer member and the final transfer member by way of the intermediate transfer member.

According to another aspect of the present invention, the image forming apparatus includes a detecting unit that detects the density of the toner image on the intermediate transfer member, in which the control unit forms in a process control mode a potential gradient for process control which causes the toner image as a detection image on the image bearing member to adhere to the cleaning member by way of the intermediate transfer member (without adhering to the final transfer member). In this case, the process control mode performs registration control and toner image density control.

By thus constructing the image forming apparatus, it is possible to prevent the toner image as the detection image from adhering to the final transfer member, without providing a retracting mechanism for making the final transfer member abut against and space apart from the intermediate transfer member. As a result, no problem is involved even if the final transfer member is constantly held in contact with the intermediate transfer member (constantly held in contact therewith also in the process control mode, the image formation mode, and the cleaning mode except when the image forming unit is replaced).

Here, the difference in potential between the final transfer member and the intermediate transfer member which is in contact with the final transfer member when forming the potential gradient for the process control may range from 0 to 1500 [V]. When this difference in potential is ensured, there is little variation in the surface potential of the intermediate transfer member, and it is possible to detect the density of the toner image on the intermediate transfer member in a stable manner.

Further, comparison of the potential gradient for image formation and the potential gradient for process control shows that the potential relationship (potential gradient) between the intermediate transfer member and the final transfer member is reversed between the potential gradient for image formation and the potential gradient for process control. Further, the potential relationship (potential gradient) between the intermediate transfer member and the cleaning member is reversed between the potential gradient for image formation and the potential gradient for process control.

Further, the control unit effects transition of the state of the image forming apparatus from the process control mode to the image formation mode. More specifically, the control unit effects transition of the state of the image forming apparatus from the process control mode directly to the image formation mode without passing the stage of the cleaning mode. Further, it is also possible to construct the control unit such that selection is appropriately made between the case in which transition of the state of the image forming apparatus is effected from the process control mode directly to the image formation mode without passing the stage of the cleaning mode and the case in which transition is effected from the process control mode to the image formation mode through the cleaning mode.

The operation of the process control mode may be performed immediately after turning on the power of the image forming apparatus or between one image formation mode and the next image formation mode.

While the image forming apparatus of the present invention may be formed as a monochrome image forming apparatus, it may also be formed as a multicolor image forming apparatus. When it is formed as a multicolor image forming apparatus, it is possible to adopt a construction which has as the image bearing member plural image bearing members for different colors and which has as the intermediate transfer device a single intermediate transfer member, or a construction which has as the image bearing member plural image bearing members for different colors and which has as the intermediate transfer device a first upstream side intermediate transfer member which is in contact with a part of the plural image bearing members, a first downstream side intermediate transfer member which is in contact with a part of the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, the final transfer member being in contact with the second intermediate transfer member. As the plural image bearing members, it is possible to provide three image bearing members for yellow, magenta, and cyan, or four image bearing members for yellow, magenta, cyan, and black. Further, it is also possible to provide image bearing members for other colors.

In the case of providing as the image bearing member four image bearing members for yellow, magenta, cyan, and black, there are provided as the intermediate transfer device a first upstream side intermediate transfer member and a first downstream side intermediate transfer member which are respectively in contact with two of the four image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, in which the final transfer member is in contact with the second intermediate transfer member.

When the intermediate transfer device is thus formed by the first (upstream side and downstream side) intermediate transfer members and the second intermediate transfer member, the detecting unit can detect the density of the toner images on the first (upstream side and downstream side) intermediate transfer members and the density of the toner image on the second intermediate transfer member.

Further, as the cleaning member, it is also possible to provide a first upstream side cleaning member which is in contact with the first upstream side intermediate transfer member and a second cleaning member which is in contact with the second intermediate transfer member. In this case, the control unit can form in the image formation mode a potential gradient for image formation in which the reverse-polarity toner on the final transfer member adheres to the second cleaning member by way of the second intermediate transfer member, and can form in the process control mode a potential gradient for process control in which the toner image as the detection image on the image bearing member adheres to the second cleaning member by way of the first upstream side intermediate transfer member, the first downstream side intermediate transfer member, and the second intermediate transfer member (without adhering to the final transfer member). Further, it can form in the process control mode a potential gradient for process control in which the reverse-polarity toner on the final transfer member adheres to the first upstream side cleaning member by way of the second intermediate transfer member and the first upstream side intermediate transfer member.

Further, as the cleaning member, it is also possible to provide a first downstream side cleaning member which is in contact with the first downstream side intermediate transfer member. In this case, the control unit can form in the process control mode a potential gradient for process control in which the reverse-polarity toner on the final transfer member adheres to the first downstream side cleaning member by way of the second intermediate transfer member and the first downstream side intermediate transfer member.

Further, the cleaning member is a cleaning roll and is provided with a cleaning device having a cleaning blade in press contact with the cleaning roll and an accommodating member which recovers toner removed through cleaning by the cleaning roll and the cleaning blade.

Further, the surface roughness (Rz) of the final transfer member may be 20 [$\mu$m (Rz)] or less, and the surface roughness (Rz) of the intermediate transfer member may be 10 [$\mu$m (Rz)] or less. Furthermore, the final transfer member may have a higher degree of surface roughness (Rz) than the intermediate transfer member. It is desirable for these surface roughnesses (Rz) to be not more than the average grain size of the toner forming the toner image. When these conditions are satisfied, it is advantageously easy for the residual toner to move from the final transfer member to the intermediate transfer member (the second intermediate transfer member). The surface of the final transfer member may be formed of a resin coating layer or a resin tube layer.

In accordance with the present invention, it is possible to provide an image forming apparatus which is compact and inexpensive and which allows cleaning of the final transfer member.

BRIEF DESCRIPTION OF THE DRAWINGS

Preferred embodiments of the present invention will be described in detail based on the following figures, wherein.

DETAILED DESCRIPTION OF THE PREFERRED EMBODIMENT

Preferred embodiments of the present invention will now be described in detail.

Figure 1:
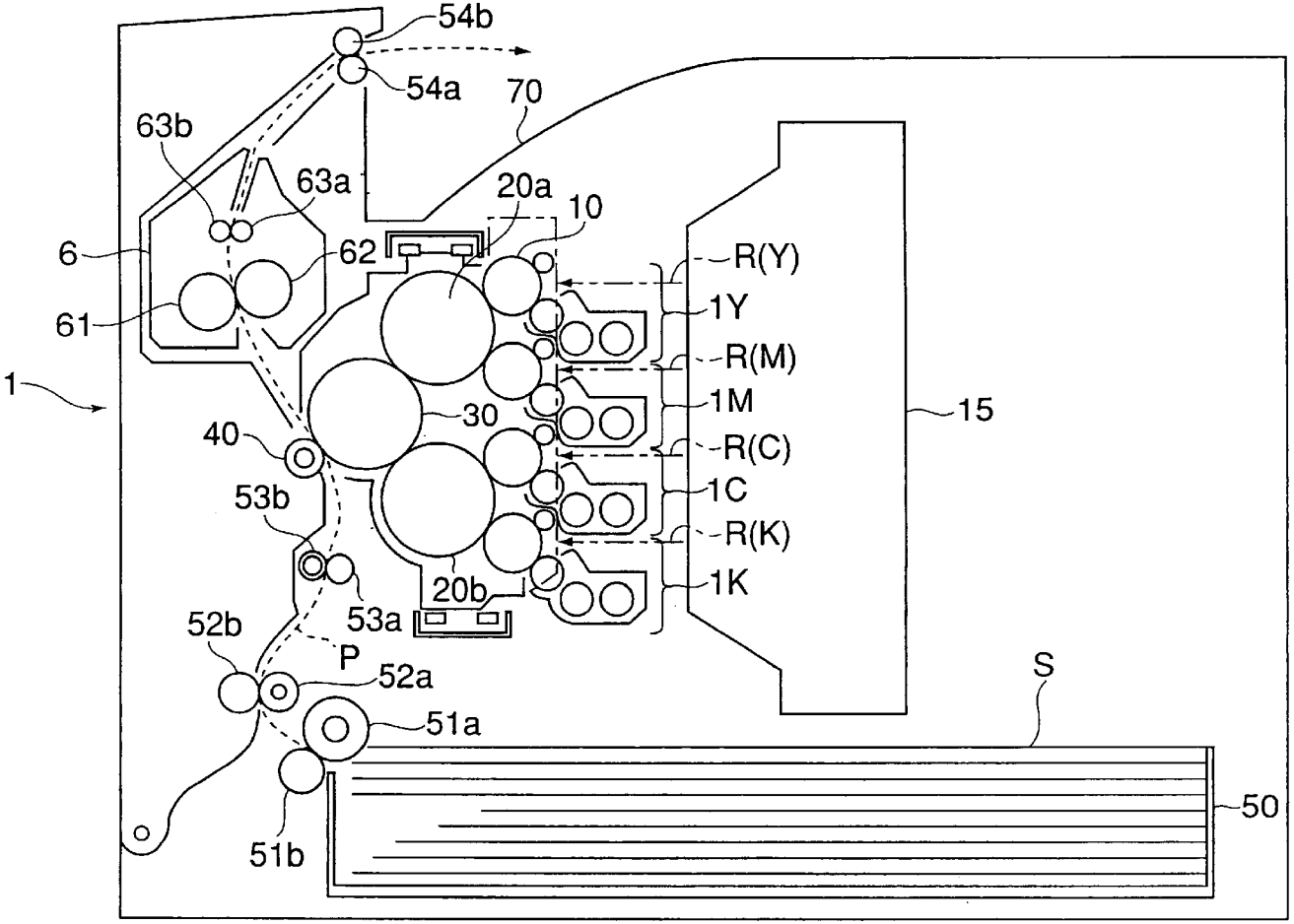
FIG. 1 is a schematic sectional view of a full color printer according to Embodiment 1 of the present invention.
Figure 2:
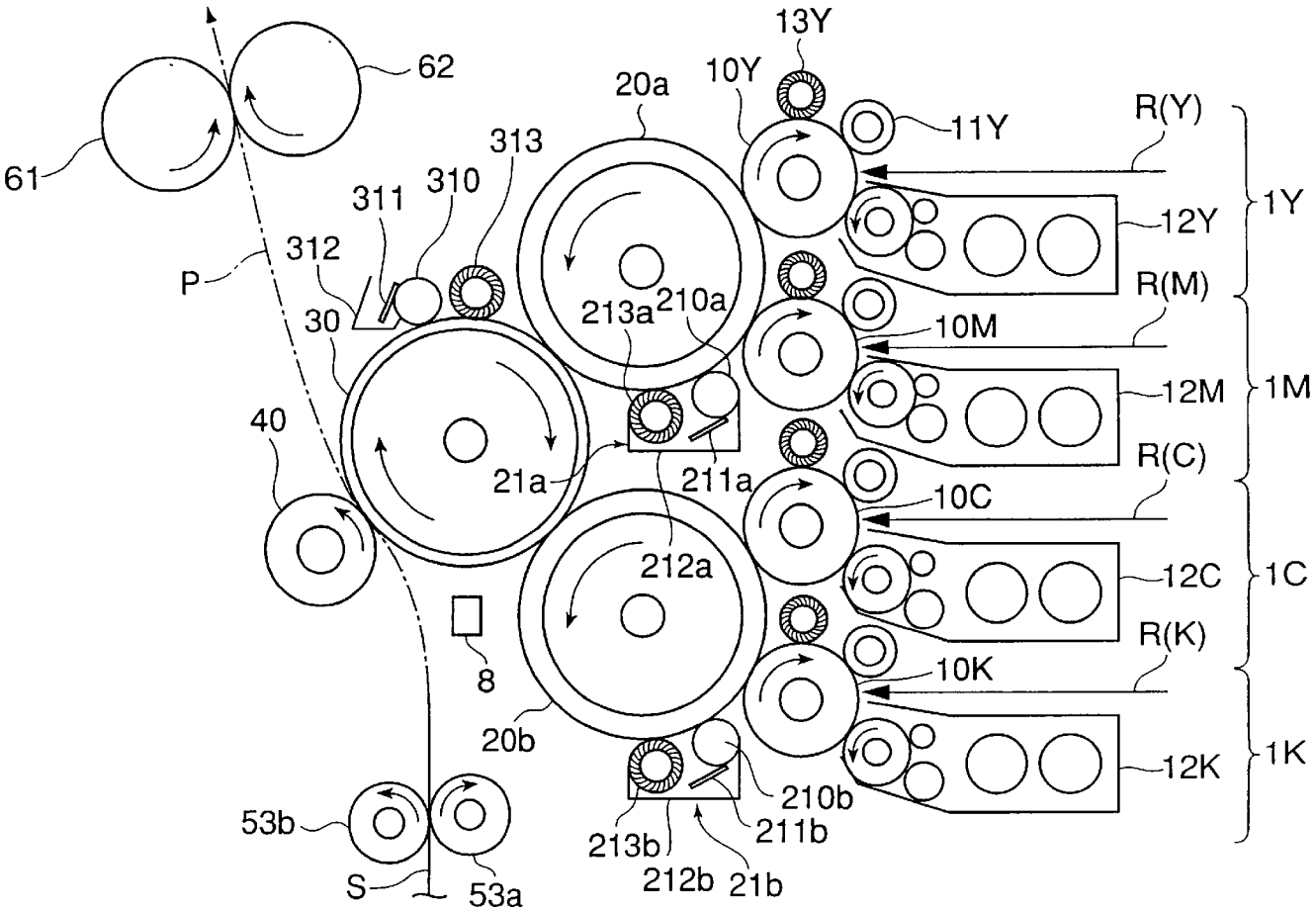
FIG. 2 is a main-portion sectional view of the full color printer of Embodiment 1 of the present invention.

Embodiment 1 FIG. 1 shows a tandem type full color printer (image forming apparatus) according to Embodiment 1 of the present invention. FIG. 2 is shows a main image forming portion of the full color printer (image forming apparatus) shown in FIG. 1.

This full color printer 1 is roughly composed of an image forming portion, an intermediate transfer device, a final transfer roll 40, a fixing device 6, and a sheet feeding portion.

The image forming portion is composed of four image forming units 1Y through 1K for yellow (Y), magenta (M), cyan (C), and black (K), and an exposure device 15. The image forming units 1Y through 1K are respectively composed of four photosensitive drums (image bearing members) 10Y through 10K, charging rolls (contact type charging members) 11Y through 11K which are respectively in contact with the photosensitive drums 10Y through 10K, developing devices 12Y through 12K respectively opposed to the photosensitive drums 10Y through 10K, and photosensitive brush rolls 13Y through 13K which are respectively in contact with the photosensitive drums 10Y through 10K.

Regarding the arrangement of the members around each photosensitive drum 10, the charging roll 11, the developing device 12 (the developing sleeve of the developing device), a first intermediate transfer roll (described below), and the photosensitive brush roll 13 are arranged around the photosensitive drum 10 from the upstream side to the downstream side with respect to the rotating direction of the photosensitive drum 10.

A DC voltage of approximately −840 V is applied to the photosensitive drums 10Y through 10K by the charging rolls 11Y through 11K, whereby the drums are uniformly charged to approximately 300V; when electrostatic latent images are written thereto by the exposure device 15, the surface potential thereof is reduced to approximately −60 V.

Each of the developing devices 12Y through 12K is a magnetic-brush-contact, two-component development type developing device equipped with a developing roll, a developer amount regulating member, a developer carrying member, and an auger for carrying and agitating developer. The amount of developer regulated by the developer amount regulating member and carried to the developing portion is approximately 30 to 40 g/m$^2$; at this time, the charge amount of the toner existing on the developing roll is approximately −20 to −30 $\mu$C/g. An AC+DC developing voltage is applied to these developing devices 12Y through 12K to execute development; this developing voltage is composed of an AC component of approximately 4 kHz and 1.6 kvpp, and a DC component of approximately −230 V.

The intermediate transfer device is equipped with a first upstream side intermediate transfer roll (first upstream side intermediate transfer member) 20*a* which is in contact with the photosensitive drums 10Y and 10M, a first downstream side intermediate transfer roll (first downstream side intermediate transfer member) 20*b* which is in contact with the photosensitive. drums 10C and 10K, a second intermediate transfer roll 30 which is in contact with the two first intermediate transfer rolls 20*a* and 20*b*, and a toner sensor (detecting unit) 8 which detects optically and in a non-contact fashion the presence and density of a toner image on the second intermediate transfer roll 30.

Further, the first upstream side intermediate transfer roll 20*a* is equipped with a first upstream side cleaning device (cleaning device) 21*a*. This first upstream side cleaning device 21*a* is equipped with a metal (stainless steel) cleaning roll (cleaning member) 210*a* which is in contact with the first upstream side intermediate transfer roll 20*a*, a cleaning blade 211*a* abutting the cleaning roll 210*a*, an intermediate transfer brush roll 213*a* which is in contact with the intermediate transfer roll 20*a* in the vicinity of the upstream side of the cleaning roll 210*a* with respect to the rotating direction of the first upstream side intermediate transfer roll 20*a*, and a cleaner housing (accommodating member) 212*a* which accommodates the cleaning roll 210*a*, the cleaning blade 211*a* and the intermediate transfer brush roll 213*a*.

Similarly, the first downstream side intermediate transfer roll 20*b* is equipped with a first downstream side cleaning device (cleaning device) 21*b*. This first downstream side cleaning device 21*b* is equipped with a metal (stainless steel) cleaning roll (cleaning member) 210*b* which is in contact with the first downstream side intermediate transfer roll 20*b*, a cleaning blade 211*b* abutting the cleaning roll 210*b*, an intermediate transfer brush roll 213*b* which is in contact with the intermediate transfer roll 20*b* in the vicinity of the upstream side of the cleaning roll 210*b* with respect to the rotating direction of the first downstream side intermediate transfer roll 20*b*, and a cleaner housing (accommodating member) 212*b* which accommodates the cleaning roll 210*b*, the cleaning blade 211*b*, and the intermediate transfer brush roll 213*b*.

The second intermediate transfer roll 30 is equipped with a second cleaning device (cleaning device) 31. This second cleaning device 31 is equipped with a metal (stainless steel) cleaning roll (cleaning member) 310 which is in contact with the second intermediate transfer roll 30, a cleaning blade 311 abutting the cleaning roll 310, an intermediate transfer brush roll 313 which is in contact with the intermediate transfer roll 30 in the vicinity of the downstream side of the cleaning roll 310 with respect to the rotating direction of the second intermediate transfer roll 30, and a cleaner housing (accommodating member) 312 accommodating the cleaning roll 310, the cleaning blade 311, and the intermediate transfer brush roll 313.

Regarding the arrangement of the members around the first upstream side intermediate transfer roll 20*a*, the photosensitive drum 10M, the photosensitive drum 10Y, the second intermediate transfer roll 30, the intermediate transfer brush roll 213*a*, and the cleaning roll 210*a* are arranged around the first upstream side intermediate transfer roll 20*a* from the upstream side to the downstream side with respect to the rotating direction of the first upstream side intermediate transfer roll 20*a*. Further, regarding the arrangement of the members around the first downstream side intermediate transfer roll 20*b*, the photosensitive drum 10K, the photosensitive drum 10C, the second intermediate transfer roll 30, the intermediate transfer brush roll 213*b*, and the cleaning roll 210*b* are arranged around the first downstream side intermediate transfer roll 20*b* from the upstream side to the downstream side with respect to the rotating direction of the first downstream side intermediate transfer roll 20*b*. Further, regarding the arrangement of the members around the second intermediate transfer roll 30, the first upstream side intermediate transfer roll 20*a*, the first downstream side intermediate transfer roll 20*b*, the toner sensor 8, the final transfer roll 40, the cleaning roll 310, and the intermediate transfer brush roll 313 are arranged around the second intermediate transfer roll 30 from the upstream side to the downstream side with respect to the rotating direction of the second intermediate transfer roll 30.

Each of the first intermediate transfer rolls 20*a* and 20*b* is formed by providing a silicone rubber layer on a metal pipe, and forming thereon a high release coating layer; while the acceptable resistance value thereof normally ranges from $10^5$ to $10^9$ Ω, in this example, it is approximately $10^8$ Ω. And, the requisite surface potential for transferring toner images from the photosensitive drums 10Y through 10K to the first intermediate transfer rolls 20*a* and 20*b* normally ranges from approximately +250 through 500 V, and an optimum potential value can be set according to the toner charging condition, the ambient temperature, the humidity, etc.

Like the first intermediate transfer rolls 20*a* and 20*b*, the second intermediate transfer roll 30 is formed by providing a silicone rubber layer on a metal pipe and forming thereon a high release coating layer; while the acceptable resistance value thereof normally ranges from $10^8$ to $10^{12}$ Ω, in this example, it is approximately $10^{11}$ Ω (That is, it exhibits a resistance value higher than that of the first intermediate transfer rolls 20*a* and 20*b*). And, the requisite surface potential for transferring toner images from the first intermediate transfer rolls 20*a* and 20*b* to the second intermediate transfer roll 30 normally ranges from approximately +600 through 1200 V, and an optimum potential value can be set according to the toner charging condition, the ambient temperature, the humidity, etc.

The final transfer roll 40 is formed by providing an urethane rubber layer on a metal pipe and providing thereon a resin coating layer; while the acceptable resistance value thereof normally ranges from $10^6$ to $10^9$ Ω, in this example, it is approximately $10^8$ Ω (That is, it exhibits a resistance value lower than that of the second intermediate transfer roll 30). And, the transfer voltage to be applied to this final transfer roll 40 in order to transfer a toner image from the second intermediate transfer roll 30 to the sheet S (recording sheet) normally ranges from approximately+1200 through 5000 V, and an optimum voltage value can be set according to the ambient temperature, the humidity, the kind of sheet S (the resistance value thereof, etc.), etc. In this example, the constant current system is adopted, and approximately +6 μA is applied under normal temperature and normal humidity to obtain a substantially appropriate final transfer voltage of approximately +1600 to 2000 V.

Further, (unlike the first intermediate transfer rolls 20*a* and 20*b* and the second intermediate transfer roll 30), the final transfer roll 40 is not caused to abut against the cleaning roll (cleaning member). Further, (exclusive of the time when replacing the image forming unit and inclusive of the times when the apparatus is in the image formation mode, the process control mode, and the cleaning mode), the final transfer roll 40 comes into contact with the second intermediate transfer roll 30, and requires no special retracting mechanism or the like.

The surface roughness (Rz) of the final transfer roll 40 may be 20 [μm(Rz)] or less, for example, 10 [μm(Rz)], and the surface roughness (Rz) of the first and second intermediate transfer rolls 20*a*, 20*b*, and 30 maybe 10 [μm(Rz)] or less, for example, 1 [μm(Rz)]. Further, the final transfer roll 40 exhibits a higher degree of surface roughness (Rz) than the first and second intermediate transfer rolls 20*a*, 20*b*, and 30. It is desirable that the surface roughness of these rolls be not more than the average grain size of the toner forming the toner image.

In the fixing device 6, a heating roll 62 and a pressurizing roll 61 are held in press contact with each other to form a fixing nip. Arranged in the heating roll 62 is a halogen lamp (not shown) serving as the heat source; at the time of fixing, the surface of the heating roll 62 is heated to a predetermined fixing temperature. Further, on the downstream side of the fixing nip with respect to the direction in which the sheet S is transported, there are arranged fixing/discharge roll pairs 63*a* and 63*b*.

The sheet feeding portion is formed along the transport path (indicated by the dotted line) P for the sheet S extending from the sheet feeding tray 50 to the discharge tray 70. The sheet feeding tray 50 accommodates plural sheets S, and from the sheet feeding tray 50 to the downstream side of the transport path, there are sequentially arranged a roll pair formed by a pick-up roll 51*a* and a retarding roll 51*b*, a pair of transport rolls 52*a* and 52*b*, a pair of registration rolls 53*a* and 53*b*, and (on the downstream side of the final transfer roll 40 and the fixing device 6) a pair of discharge rolls 54*a* and 54*b*.

Figure 3:
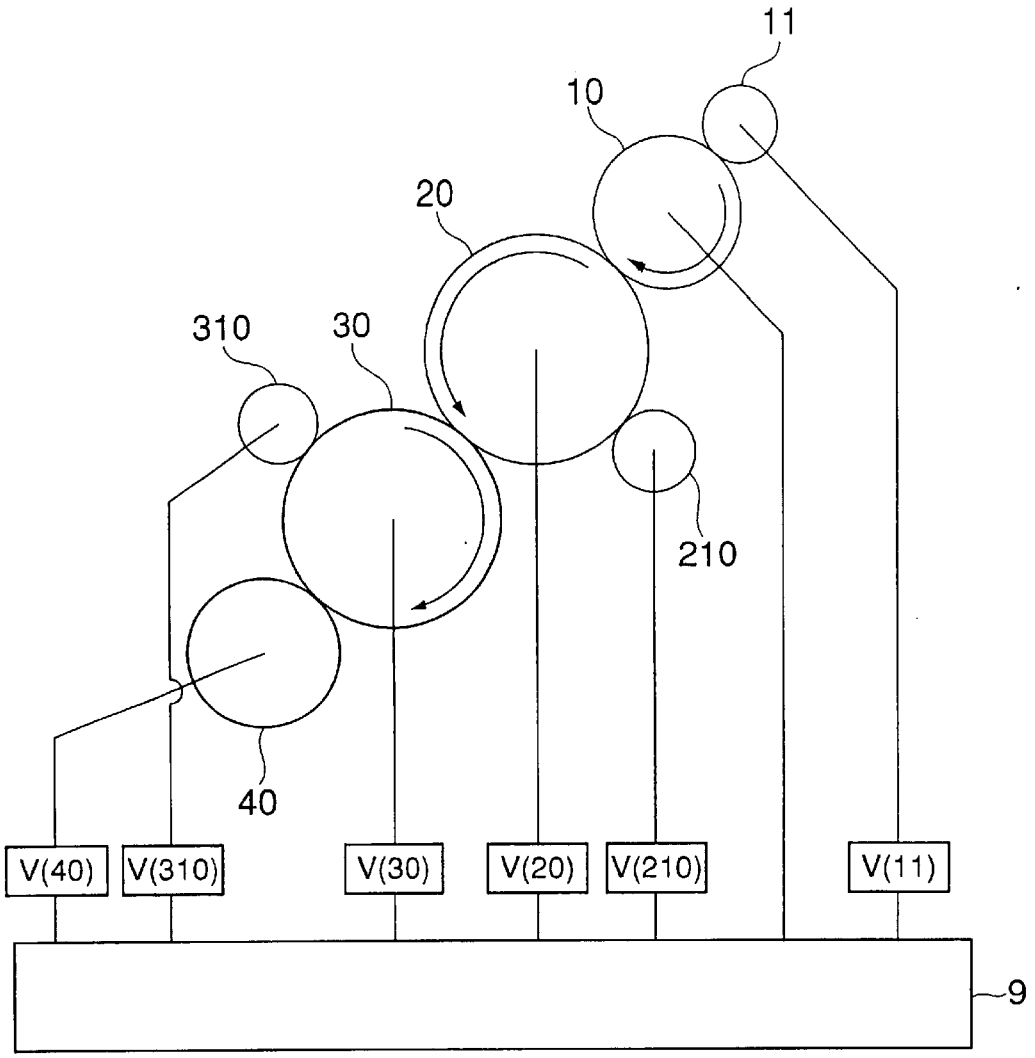
FIG. 3 is a block diagram illustrating the potential gradient control system of the full color printer of Embodiment 1 of the present invention.

FIG. 3 is a block diagram illustrating the potential control system of this full color printer 1. According to the situation the color printer 1 is in, that is, based on the fact as to whether the printer is ready for the printing mode (the image formation mode), the process control mode, or the cleaning mode, the potential control portion (control unit) 9 controls voltages V(11), V(20), V(210), V(30), V(310), and V(40) respectively applied to the charging roll 11, the first intermediate transfer rolls 20*a* and 20*b*, the cleaning roll 210, the second intermediate transfer roll 30, the cleaning roll 310, and the final transfer roll 40, with the result that according to the situation the full color printer 1 is in, an appropriate potential gradient is formed between the charging roll 11, the first intermediate transfer rolls 20*a* and 20*b*, the cleaning roll 210, the second intermediate transfer roll 30, the cleaning roll 310, and the final transfer roll 40.

The operation of this full color printer 1 will now be described.

Figure 4:
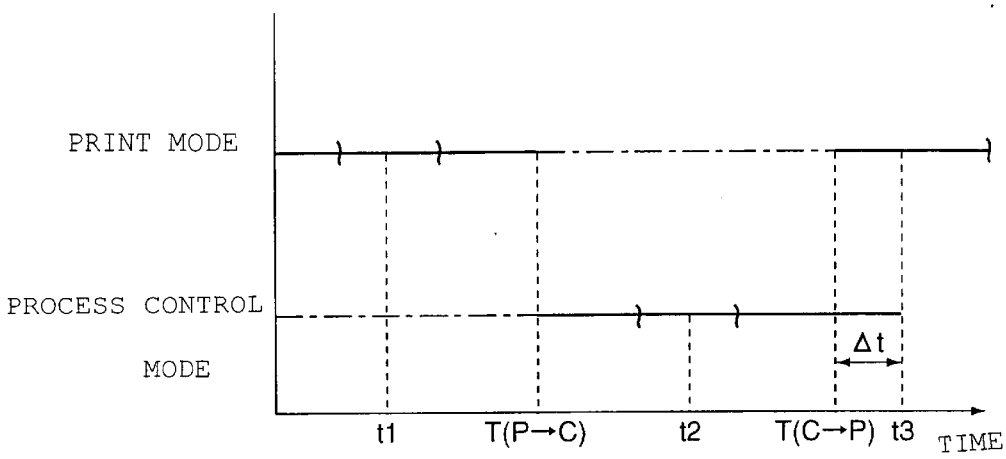
FIG. 4 shows state transition in the full color printer of Embodiment 1 of the present invention.

FIG. 4 illustrates changes with time of the operating condition of the full color printer 1 of this embodiment. Here, after the first print mode, transition to the process control mode is effected at time point T (P to C). Thereafter, transition to the second print mode is effected at time point T (C to P) (without transition to the cleaning mode) While in this case there is a process control mode between the first and second print mode, it is also possible for the process control mode to come immediately after the turning on of the power of the full color printer 1.

In the following, the state of the toner in the full color printer 1 at time point t1 which is during the first print mode, at time point t2 which is during the process control mode, and time point t3 which is immediately after transition to the second print mode will be described with reference to FIGS. 5, 6, and 7.

TABLE 1

| Condition | V (40) | V (310) | V (30) | V (20) | V (210) | V (11) |
|---|---|---|---|---|---|---|
| Print mode | 2000 | 700 | 900 | 400 | 200 | −900 |
| Process control mode | 400 | 1200 | 900 | 400 | 200 | −900 |

Given in Table 1 are the voltages to be applied, in the (first and second) print modes and the process control mode, by the potential control portion 9 of this embodiment to the charging rolls 11, the first intermediate transfer rolls 20*a* and 20*b*, the cleaning roll 210, the second intermediate transfer roll 30, the cleaning roll 310, and the final transfer roll 40.

Figure 5:
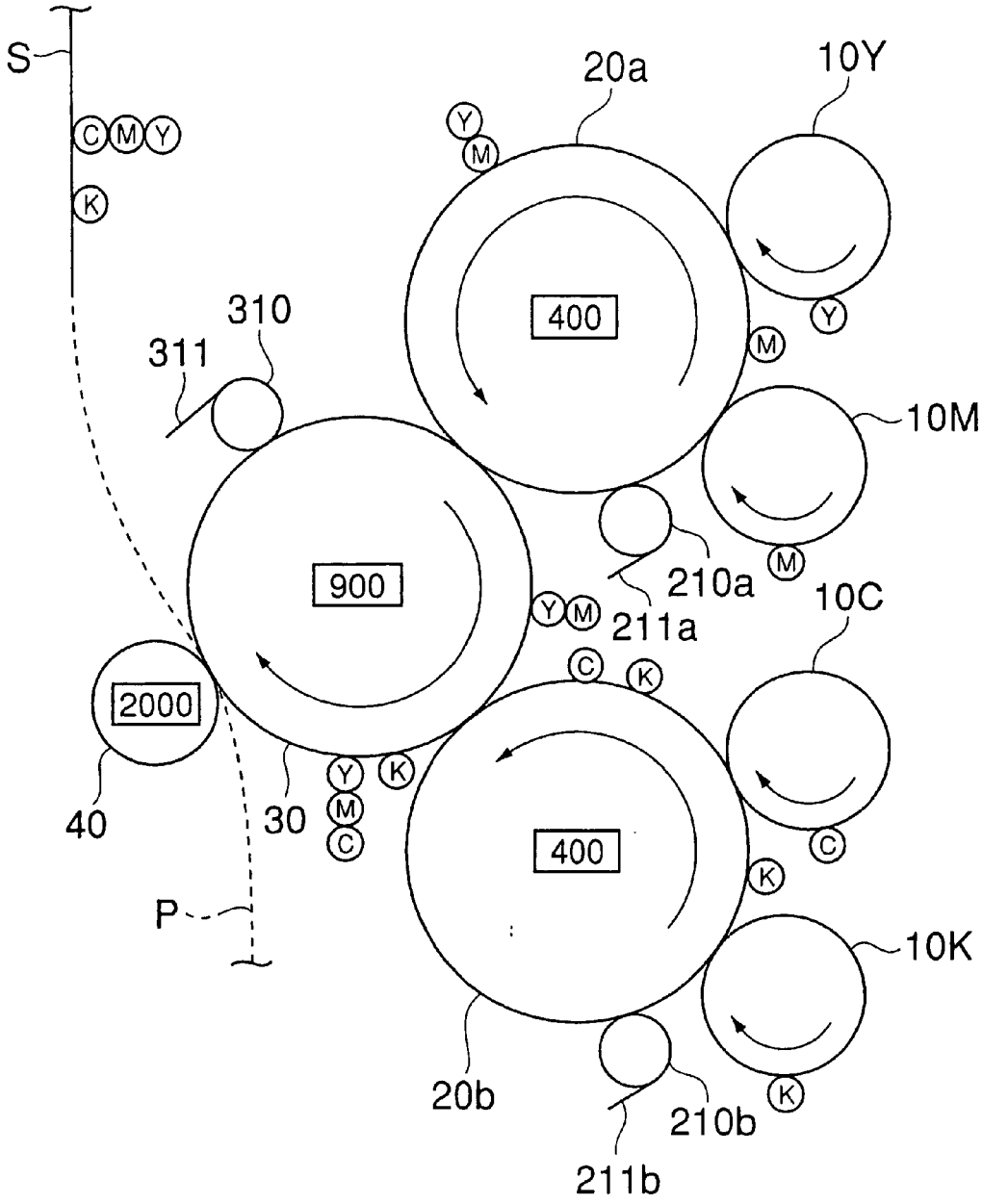
FIG. 5 illustrates the operation of the full color printer of Embodiment 1 of the present invention in the print mode.

FIG. 5 illustrates how the toner image as the output image moves at time point t1, which is during the first print mode. In the drawing, the solid-line arrow indicates the movement path of the toner image as the out put image. The toner used in this embodiment is negatively charged toner. That is, the normal-polarity toner is negatively charged, and the reverse-polarity toner is positively charged.

Yellow, magenta, cyan, and black toner images are respectively formed on the photosensitive drums 10Y through 10K by the image forming units 1Y through 1K. That is, the surface of each photosensitive drum 10 is uniformly charged by the charging roll 11, and a laser beam R corresponding to the output image is applied from the exposure device 15 to the surface of the photosensitive drum 10 after the charging, forming an electrostatic latent image on the photosensitive drum 10 through a difference in potential between the exposed portions and the unexposed portions. The developing device 12 imparts toner selectively to this electrostatic latent image to thereby form a toner image on the photosensitive drum 10.

And, a magenta toner image is primarily transferred to the first upstream side intermediate transfer roll 20*a* from the photosensitive drum 10M for magenta. Then, a yellow toner image is primarily transferred to the first upstream side intermediate transfer roll 20*a* from the photosensitive drum 10Y for yellow, and superimposed on the magenta toner image. Similarly, a black toner image is primarily transferred to the first downstream side intermediate transfer roll 20*b* from the photosensitive drum 10K for black. Then, a cyan toner image is primarily transferred to the first downstream side intermediate transfer roll 20*b* from the photosensitive drum 10C for cyan.

The primarily transferred magenta and yellow toner images are secondarily transferred to the second intermediate transfer roll 30. The primarily transferred black and cyan toner images are also secondarily transferred to the second intermediate transfer roll 30, where the cyan toner image is superimposed on the magenta and yellow toner images secondarily transferred previously to thereby form a full color toner image on the second intermediate transfer roll 30.

The full color toner image and the black toner image, which are secondarily transferred, reach the nip portion between the second intermediate transfer roll 30 and the final transfer roll 40. In synchronism with the timing of their reaching, the sheet S as the recording sheet is transported to the nip portion from the registration roll pair 53*a* and 53*b* (See FIG. 1), and the full color toner image and the black toner image are tertiarily (finally) transferred to the sheet S.

Thereafter, this sheet S passes the nip portion of the heating roll 62 and the pressurizing roll 61 of the fixing device 6 (See FIG. 1). In this process, by the action of the heat and pressure imparted from the rolls 61 and 62, the full color toner image and the black toner image are fixed to the sheet S to become a permanent image. Thereafter, the sheet S is discharged onto the discharge tray 70 by the discharge roll pair 54*a* and 54*b* to complete the full color image formation.

Figure 6:
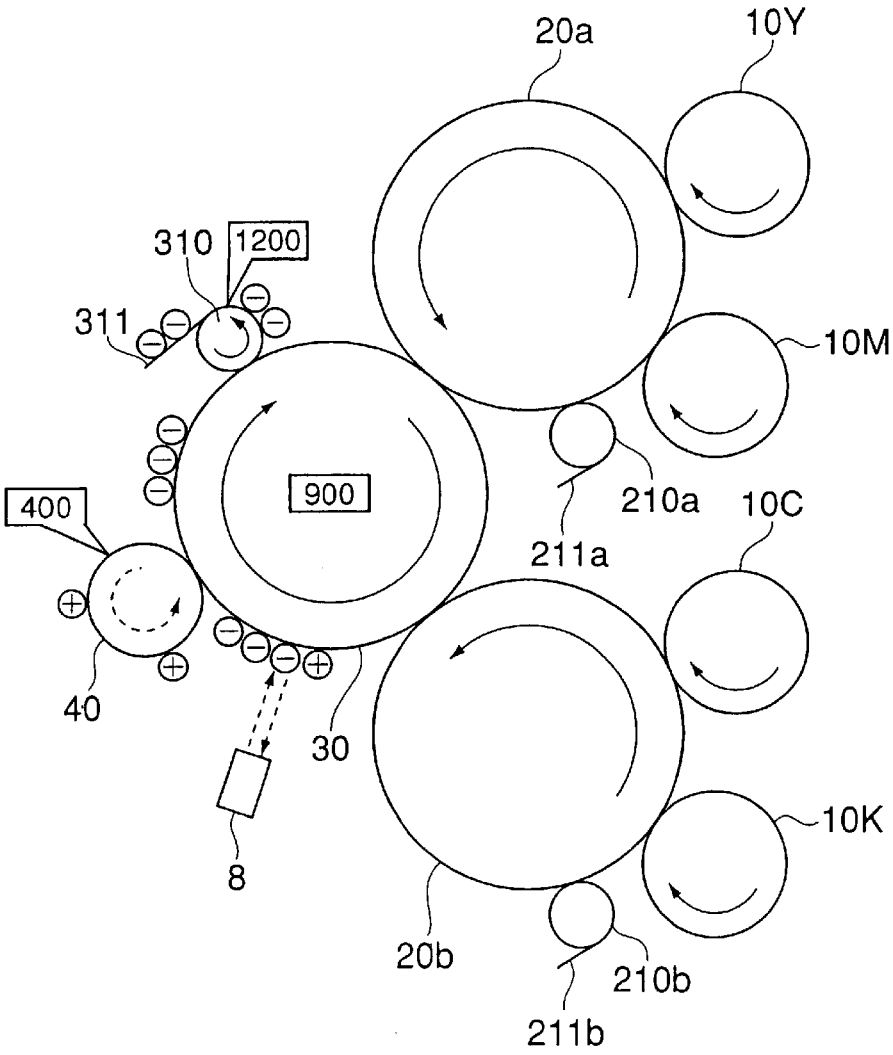
FIG. 6 illustrates the operation of the full color printer of Embodiment 1 of the present invention in the process control mode.

FIG. 6 illustrates how the toner image as the detection image moves at time point t2, which is during the process control mode. In the drawing, the solid-line arrow indicates the movement path of the toner image as the detection image.

Yellow, magenta, cyan, and black toner images are formed on the photosensitive drums 10Y through 10K by the image forming units 1Y through 1K. And, first, the magenta toner image is primarily transferred to the first upstream side intermediate transfer roll 20*a* from the photosensitive drum 10M for magenta. Then, the yellow toner image is primarily transferred to the first upstream side intermediate transfer roll 20*a* from the photosensitive drum 10Y for yellow. Here, a toner image (toner patch) as a monochrome detection image is formed, so that the yellow toner image and the magenta toner image are not super imposed one upon the other. Further, the black toner image is primarily transferred to the first downstream side intermediate transfer roll 20*b* from the photosensitive drum 10K for black. Then, the cyan toner image is primarily transferred to the first downstream side intermediate transfer roll 20*b* from the photosensitive drum 10C for cyan. The black toner image and the cyan toner image are not superimposed one upon the other, either.

The primarily transferred magenta and yellow toner images are secondarily transferred to the second intermediate transfer roll 30. The primarily transferred black and cyan toner images are also secondarily transferred to the second intermediate transfer roll 30. Also here, the cyan toner image and the black toner image are not superimposed on the magenta toner image and the yellow toner image, which are secondarily transferred previously, each toner image being independently secondarily transferred to the second intermediate transfer roll 30.

The relative positional relationship, density, etc. of the secondarily transferred toner images (toner patches) of the different colors are detected by the toner sensor 8 opposed to the secondary transfer roll 30 in a non-contact state, and, on the basis of the detection results, the exposure timing for the exposure device 15, the charging biases, the developing biases, the toner supply amounts in the developing devices 13, etc. are controlled.

Most of the toner forming the toner images (toner patches) after the detection is negatively charged, so that it is not transferred to the final transfer roll 40 even if it is brought into contact with the final transfer roll 40 (At this time, the sheet S is not transported), and move as they are with the rotation of the second intermediate transfer roll 30, adhering to the cleaning roll 310 constituting the second cleaning device 31. And, the toners are scraped off the surface of the cleaning roll 310 by the cleaning blade 311, and accommodated in the cleaner housing 312. It is also possible to adopt a construction in which the accommodated toners are carried into a recovery box (not shown). A portion of the toners forming the toner images (toner patches) after the detection is positively charged. Such reverse-polarity toner comes into contact with the final transfer roll 40 and retained thereon, and does not move to the second intermediate transfer roll 30 and the cleaning roll 310 like the normal-polarity toner.

Figure 7:
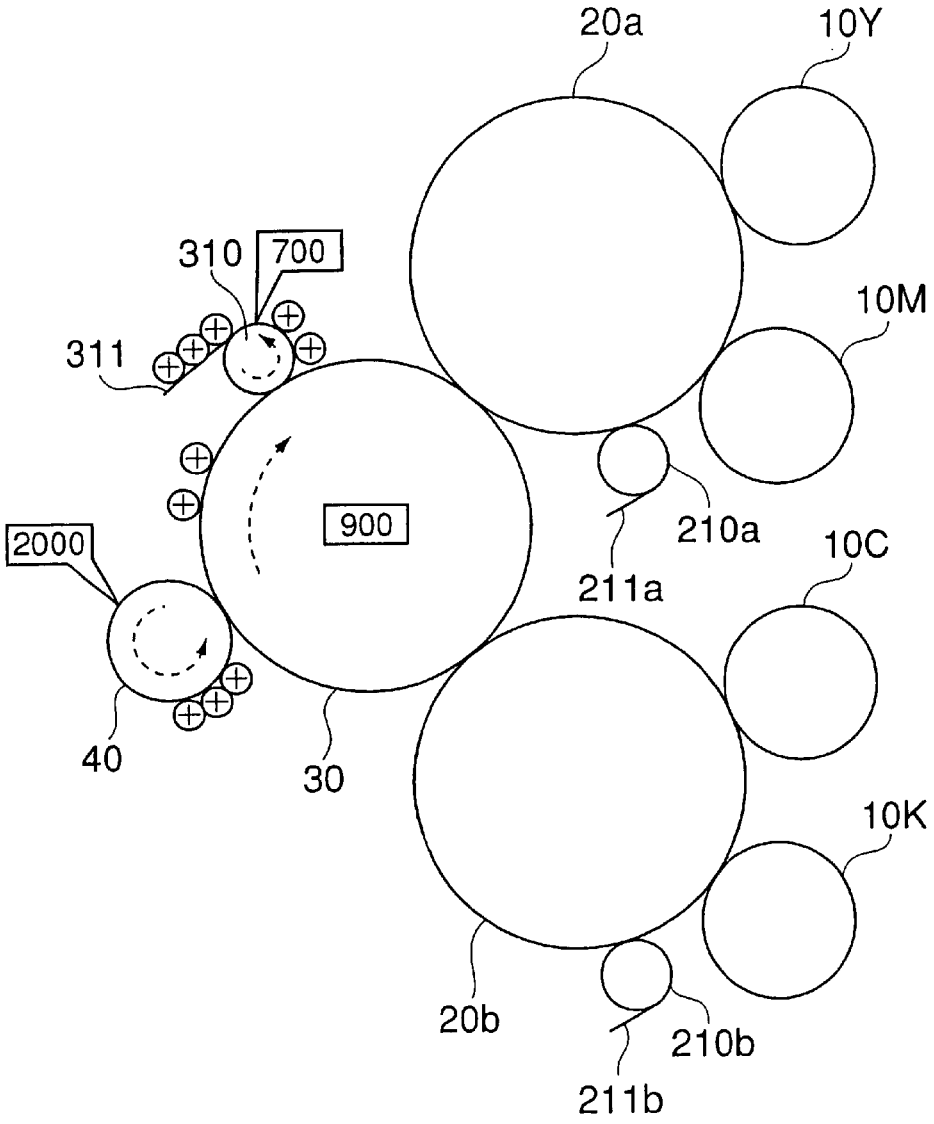
FIG. 7 illustrates the operation of the full color printer of Embodiment 1 of the present invention in the initial stage of the print mode.

FIG. 7 illustrates how the toner image as the detection image moves at time point t3, which is immediately after transition to the second print mode (t3−T(C to P)=Δt) and prior the final transfer of toner to the sheet S. In the drawing, the dotted-line arrow indicates the movement path of the reverse-polarity toner on the final transfer roll 40.

The positively charged toner which has been caused to adhere to the final transfer roll 40 in the foregoing process control mode, that is, the reverse-polarity toner, moves from the final transfer roll 40 to the second intermediate transfer roll 30. Further, it moves with the rotation of the second intermediate transfer roll 30, adhering to the cleaning roll 310 constituting the second cleaning device 31. Then, it is scraped off the surface of the cleaning roll 310 by the cleaning blade 311 to be accommodated in the cleaner housing 312.

By thus controlling the potential gradient of the full color printer 1, it is possible to remove the reverse-polarity toner on the final transfer roll 40 in the initial stage of the print mode, without providing the final transfer roll 40 with any cleaning device or providing any mechanism for making the final transfer roll 40 abut against and space apart from the second intermediate transfer roll 30, so that it is possible to provide a compact and inexpensive full color printer.

Modification While in Embodiment 1 the reverse-polarity toner on the final transfer roll 40 is removed by the second cleaning device 31 in the initial stage of the print mode, in the full color printer 1 of this modification, the reverse-polarity toner is removed by a first upstream side cleaning device 21*a* and a first downstream side cleaning device 21*b*. In the following, the operation of the full color printer 1 of this modification will be described centering on the difference between it and Embodiment 1.

TABLE 2

| Condition | V (40) | V (310) | V (30) | V (20) | V (210) | V (11) |
|---|---|---|---|---|---|---|
| Print mode | 2000 | 1200 | 900 | 400 | 200 | −900 |
| Process control mode | 400 | 1200 | 900 | 400 | 200 | −900 |

Given in Table 2 are the voltages to be applied, in the (first and second) print modes and the process control mode, by the potential control portion 9 of this modification to the charging rolls 11, the first intermediate transfer rolls 20*a* and 20*b*, the cleaning roll 210, the second intermediate transfer roll 30, the cleaning roll 310, and the final transfer roll 40.

In this modification, the way the toner image as the output image moves at time point t1, which is during the first print mode (See FIG. 5), and the way the toner image as the detection image moves at time point t2, which is during the process control mode (See FIG. 6) are the same as those in Embodiment 1, so that a description thereof will be omitted.

Figure 8:
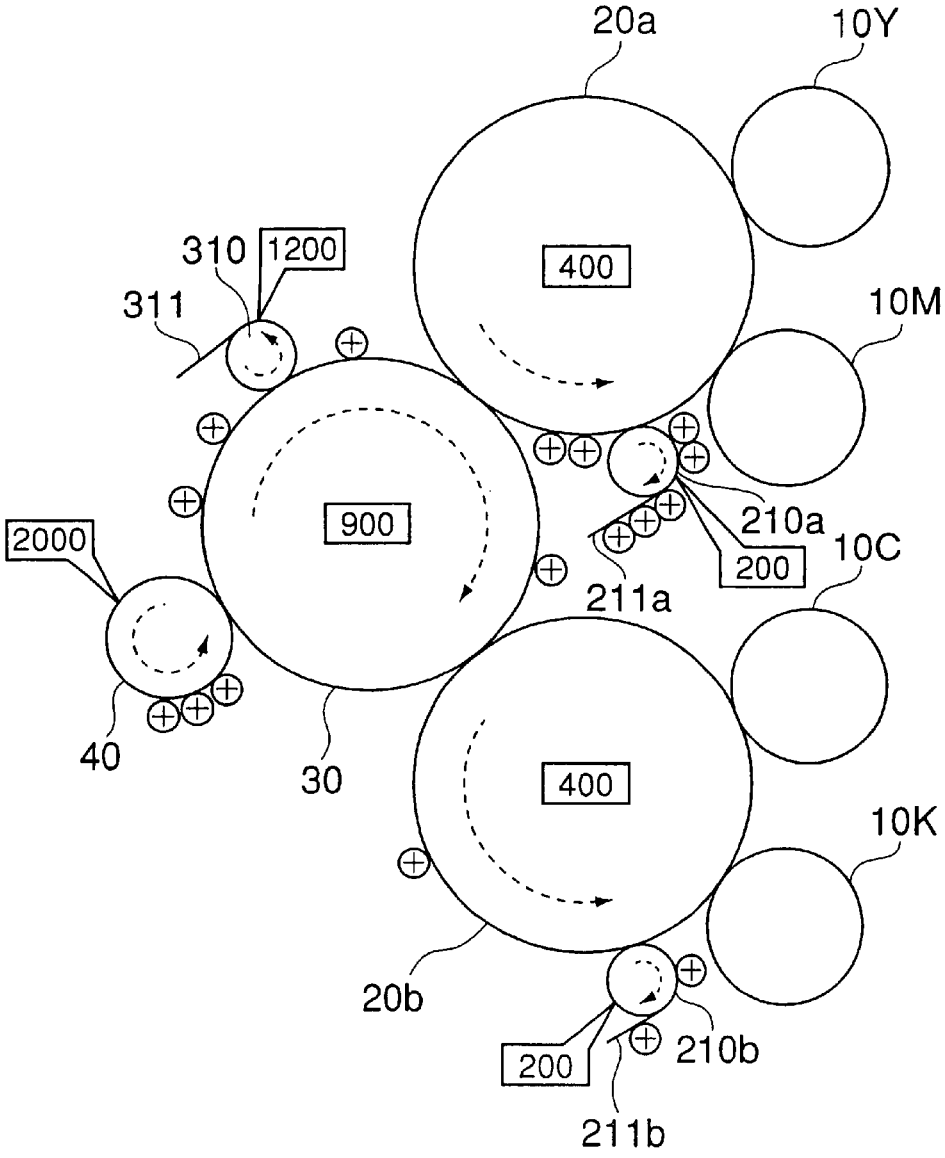
FIG. 8 illustrates the operation of a full color printer according to a modification of the present invention in the initial stage of the print mode.

FIG. 8 illustrates how the toner image as the detection image moves at time point t3, which is immediately after transition to the second print mode (t3−T(C to P)=Δt) and prior to the final transfer of toner to the sheet S. In the drawing, the dotted-line arrow indicates the movement path of the reverse-polarity toner on the final transfer roll 40.

The positively charged toner which has been caused to adhere to the final transfer roll 40 in the previous process control mode, that is, the reverse-polarity toner, moves from the final transfer roll 40 to the second intermediate transfer roll 30. And, the toner moves with the rotation of the second intermediate transfer roll 30, reaching the cleaning roll 310 portion. However, due to the potential relationship between the second intermediate transfer roll 30 and the cleaning roll 310, the toner does not adhere to the cleaning roll 310.

Then, the toner moves further with the rotation of the second intermediate transfer roll 30, and reaches the first upstream side intermediate transfer roll 20*a* portion. Due to the potential relationship between the second intermediate transfer roll 30 and the first upstream side intermediate transfer roll 20*a*, the majority of the reverse-polarity toner moves to the first upstream side intermediate transfer roll 20*a*. And, the toner moves with the rotation of the first upstream side intermediate transfer roll 20*a*, and adheres to the cleaning roll 210*a* constituting the first upstream side cleaning device 21*a*. And, the toner is scraped off the surface of the cleaning roll 210*a* by the cleaning blade 211*a* to be accommodated in the cleaner housing 212*a*.

The portion of the reverse-polarity toner which has not moved to the first upstream side intermediate transfer roll 20*a* moves further with the rotation of the second intermediate transfer roll 30, and reaches the first downstream side intermediate transfer roll 20*b* portion. Due to the potential relationship between the second intermediate transfer roll 30 and the first downstream side intermediate transfer roll 20*b*, the reverse-polarity toner moves to the first downstream side intermediate transfer roll 20*b*. And, the toner moves with the rotation of the first downstream side intermediate transfer roll 20*b*, and adheres to the cleaning roll 210*b* constituting the first downstream side cleaning device 21*b*. And, the toner is scraped off the surface of the cleaning roll 210*b* by the cleaning blade 211*b* to be accommodated in the cleaner housing 212*b*.

By thus controlling the potential gradient of the full color printer 1, it is possible to remove the reverse-polarity toner on the final transfer roll 40 in the initial stage of the print mode, without providing the final transfer roll 40 with any cleaning device or providing any mechanism for making the final transfer roll 40 abut against and space apart from the second intermediate transfer roll 30, so that it is possible to provide a compact and inexpensive full color printer.

Embodiment 2 While the full color printer 1 of Embodiment 1 has as the intermediate transfer device plural (three) intermediate transfer members: the first upstream side intermediate transfer roll 20*a*, the first downstream side intermediate transfer roll 20*b*, and the second intermediate transfer roll 30, the monochrome printer 1 of this embodiment has as the intermediate transfer device only one intermediate transfer roll 20. The components that are the same as those of the full color printer 1 of Embodiment 1 are indicated by the same reference numerals, and a description thereof will be omitted.

In the following, the operation of this monochrome printer 1 will be described.

Figure 9:
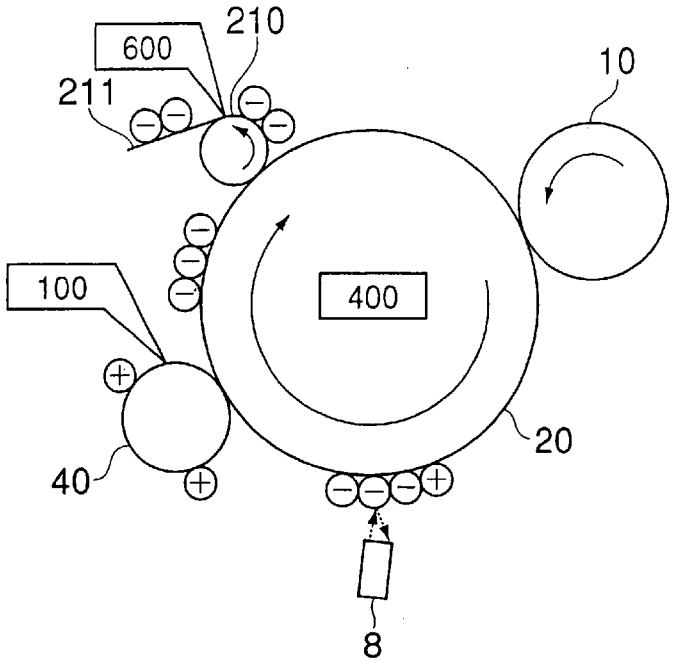
FIG. 9 illustrates the operation of a monochrome printer according to Embodiment 2 of the present invention in the process control mode.

FIG. 9 illustrates how the toner image as the detection image moves at time point t2, which is during the process control mode. In the drawing, the solid-line arrow indicates the movement path of the toner image as the detection image.

A black toner image is formed on the photosensitive drum 10. And, this toner image is primarily transferred to the intermediate transfer roll 20. The relative positional relationship, density, etc. of the primarily transferred toner image (toner patch) are detected by the toner sensor 8 opposed to the intermediate transfer roll 20 in a non-contact state, and, on the basis of the detection results, the exposure timing for the exposure device 15, the charging bias, the developing bias, the toner supply amount in the developing device 12, etc. are controlled.

Most of the toner forming the toner image (toner patch) after the detection is negatively charged, so that it is not transferred to the final transfer roll 40 even if it is brought into contact therewith (At this time, the sheet S is not transported), and moves as it is with the rotation of the intermediate transfer roll 20, adhering to the cleaning roll 210 constituting the cleaning device 21. Then, it is scraped off the surface of the cleaning roll 210 by the cleaning blade 211 to be accommodated in the cleaner housing 212. At the same time, there exists a positively charged portion of the toner forming the toner image (toner patch) after the detection. Such reverse-polarity toner is in contact with the final transfer roll 40 and retained thereon, and does not move to the intermediate transfer roll 20 and the cleaning roll 210 like the normal-polarity toner.

Figure 10:
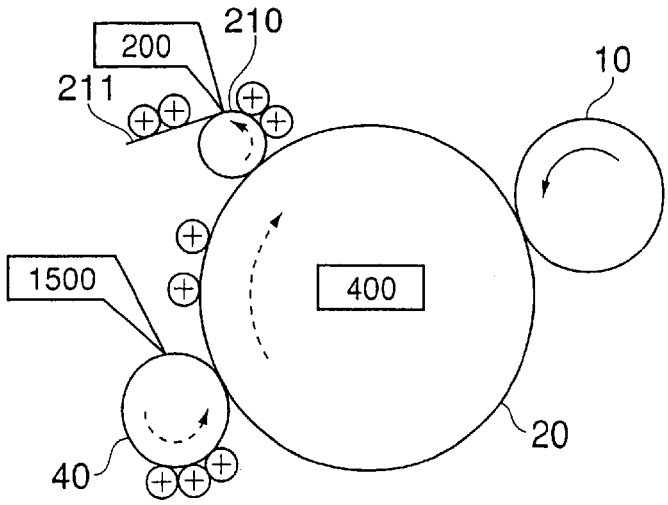
FIG. 10 illustrates the operation of the monochrome printer of Embodiment 2 of the present invention in the initial stage of the print mode.

FIG. 10 illustrates how the toner image as the detection image moves at a time point t3, which is immediately after transition to the second print mode ($t3-T(C \text{ to } P)=\Delta t$) and prior to the final transfer of toner to the sheet S. In the drawing, the dotted-line arrow indicates the movement path of the reverse-polarity toner on the final transfer roll 40.

The positively charged toner which has been caused to adhere to the final transfer roll 40 in the previous process control mode, that is, the reverse-polarity toner, moves from the final transfer roll 40 to the intermediate transfer roll 20. Further, it moves with the rotation of the intermediate transfer roll 20, and adheres to the cleaning roll 210 constituting the cleaning device 21. Then, it is scraped of the surface of the cleaning roll 210 by the cleaning blade 211, and accommodated in the cleaner housing 212.

By thus controlling the potential gradient of the monochrome printer 1, it is possible to remove the reverse-polarity toner on the final transfer roll 40 in the initial stage of the print mode without providing the final transfer roll 40 with a cleaning device or providing a mechanism for making the final transfer roll 40 abut against and space apart from the intermediate transfer roll 20, so that it is possible to provide a compact and inexpensive monochrome printer.

What is claimed is:

1. An image forming apparatus comprising: an image bearing member; an image forming unit which forms a toner image on a surface of the image bearing member; an intermediate transfer device formed by at least one intermediate transfer member and which is in contact with the image bearing member; a final transfer member which is in contact with the intermediate transfer member; a cleaning member which is in contact with the intermediate transfer member; and a control unit which controls a potential gradient between the image bearing member, the intermediate transfer member, the final transfer member, and the cleaning member, wherein the control unit forms in an image formation mode a potential gradient for image formation which causes reverse-polarity toner on the final transfer member to adhere to the cleaning member by way of the intermediate transfer member.

2. An image forming apparatus according to claim 1, wherein the cleaning member does not come into contact with the final transfer member.

3. An image forming apparatus according to claim 1, wherein due to the potential gradient for image formation, the toner image as an output image on the image bearing member is transferred to a recording sheet transported between the intermediate transfer member and the final transfer member by way of the intermediate transfer member.

4. An image forming apparatus according to claim 1, further comprising a detecting unit which detects a density of the toner image on the intermediate transfer member, wherein the control unit forms in a process control mode a potential gradient for process control which causes the toner image as a detection image on the image bearing member to adhere to the cleaning member by way of the intermediate transfer member.

5. An image forming apparatus according to claim 1, further comprising a detecting unit which detects a density of the toner image on the intermediate transfer member, wherein the control unit forms in a process control mode a potential gradient for process control which causes the toner image as a detection image on the image bearing member to adhere to the cleaning member by way of the intermediate transfer member, and wherein the final transfer member is in contact with the intermediate transfer member at least in the process control mode.

6. An image forming apparatus according to claim 1, further comprising a detecting unit which detects a density of the toner image on the intermediate transfer member, wherein the control unit forms in a process control mode a potential gradient for process control which causes the toner image as a detection image on the image bearing member to adhere to the cleaning member by way of the intermediate transfer member, and wherein a difference in potential between the final transfer member and the intermediate transfer member which is in contact with the final transfer member when forming the potential gradient for process control ranges from 0 to 1500 [V].

7. An image forming apparatus according to claim 1, further comprising a detecting unit which detects a density of the toner image on the intermediate transfer member, wherein the control unit forms in a process control mode a potential gradient for process control which causes the toner image as a detection image on the image bearing member to adhere to the cleaning member by way of the intermediate transfer member, and wherein the potential gradient between the intermediate transfer member and the final transfer member is reversed between the potential gradient for image formation and the potential gradient for process control.

8. An image forming apparatus according to claim 1, further comprising a detecting unit which detects a density of the toner image on the intermediate transfer member, wherein the control unit forms in a process control mode a potential gradient for process control which causes the toner image as a detection image on the image bearing member to adhere to the cleaning member by way of the intermediate transfer member, and wherein the potential gradient between the intermediate transfer member and the cleaning member is reversed between the potential gradient for image formation and the potential gradient for process control.

9. An image forming apparatus according to claim 1, wherein due to the potential gradient for image formation, the toner image as an output image on the image bearing member is transferred to a recording sheet transported between the intermediate transfer member and the final transfer member by way of the intermediate transfer member, and wherein the control unit effects transition of the state of the image forming apparatus from a process control mode to an image formation mode.

10. An image forming apparatus according to claim 1, wherein due to the potential gradient for image formation, the toner image as an output image on the image bearing member is transferred to a recording sheet transported between the intermediate transfer member and the final transfer member by way of the intermediate transfer member, and wherein the control unit effects immediate transition of the state of the image forming apparatus from a process control mode to an image formation mode without transition to a cleaning mode.

11. An image forming apparatus according to claim 1, wherein due to the potential gradient for image formation, the toner image as an output image on the image bearing member is transferred to a recording sheet transported between the intermediate transfer member and the final transfer member by way of the intermediate transfer member, and wherein an operation of a process control mode is performed immediately after turning on the power of the image forming apparatus.

12. An image forming apparatus according to claim 1, wherein due to the potential gradient for image formation, the toner image as an output image on the image bearing member is transferred to a recording sheet transported between the intermediate transfer member and the final transfer member by way of the intermediate transfer member, and wherein an operation of a process control mode is performed between one image formation mode and the next image formation mode.

13. An image forming apparatus according to claim 1, further comprising: as the image bearing member plural image bearing members for different colors; and as the intermediate transfer device a first intermediate transfer member.

14. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member.

15. An image forming apparatus according to claim 1, further comprising: as the image bearing member four image bearing members for yellow, magenta, cyan, and black; and as the intermediate transfer device a first upstream side intermediate transfer member and a first downstream side intermediate transfer member respectively in contact with two of the four image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member.

16. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member, and wherein the detecting unit detects a density of the toner image on the second intermediate transfer member.

17. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member, and wherein as the cleaning member, a first upstream side cleaning member which is in contact with the first upstream side intermediate transfer member and a second cleaning member which is in contact with the second intermediate transfer member are provided.

18. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member, wherein as the cleaning member, a first upstream side cleaning member which is in contact with the first upstream side intermediate transfer member and a second cleaning member which is in contact with the second intermediate transfer member are provided, and wherein the control unit forms in the image formation mode a potential gradient for image formation which causes the reverse-polarity toner on the final transfer member to adhere to the second cleaning member by way of the second intermediate transfer member.

19. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member, wherein as the cleaning member, a first upstream side cleaning member which is in contact with the first upstream side intermediate transfer member and a second cleaning member which is in contact with the second intermediate transfer member are provided, and wherein the control unit forms in the process control mode a potential gradient for process control which causes the toner image as the detection image on the image bearing member to adhere to the second cleaning member by way of the first upstream side intermediate transfer member, the first downstream side intermediate transfer member, and the second intermediate transfer member.

20. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein the final transfer member is in contact with the second intermediate transfer member, wherein the detecting unit detects a density of the toner image on the second intermediate transfer member, and wherein the control unit forms in the process control mode a potential gradient for process control which causes the reverse-polarity toner on the final transfer member to adhere to the first upstream side cleaning member by way of the second intermediate transfer member and the first upstream side intermediate transfer member.

21. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein as the cleaning member, a first downstream side cleaning member which is in contact with the first downstream side intermediate transfer member is provided.

22. An image forming apparatus according to claim 1, further comprising: as the image bearing member plural image bearing members for different colors; and as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, wherein as the cleaning member, a first downstream side cleaning member which is in contact with the first downstream side intermediate transfer member is provided, and wherein the control unit forms in the process control mode a potential gradient for process control which causes the reverse-polarity toner on the final transfer member to adhere to the first downstream side cleaning member by way of the second intermediate transfer member and the first downstream side intermediate transfer member.

23. An image forming apparatus according to claim 1, wherein the cleaning member is a cleaning roll and is provided with a cleaning device having a cleaning blade in press contact with the cleaning roll and an accommodating member which recovers toner removed through cleaning by the cleaning roll and the cleaning blade.

24. An image forming apparatus according to claim 1, wherein a surface roughness (Rz) of the final transfer member is 20 [$\mu$m (Rz)] or less.

25. An image forming apparatus according to claim 1, wherein a surface roughness (Rz) of the intermediate transfer member is 10 [$\mu$m (Rz)] or less.

26. An image forming apparatus according to claim 1, wherein the final transfer member has a higher degree of surface roughness (Rz) than the intermediate transfer member.

27. An image forming apparatus according to claim 1, wherein a surface of the final transfer member is formed of a resin coating layer or a resin tube layer.

* * * * *